US007712619B2

(12) United States Patent
Schwarz et al.

(10) Patent No.: US 7,712,619 B2
(45) Date of Patent: May 11, 2010

(54) SCREW CAP

(75) Inventors: Wolfhard Schwarz, Worms (DE); Engelbert Eisele, Worms (DE)

(73) Assignee: Alcoa Deutschland GmbH, Worms am Rhein (DE)

( * ) Notice: Subject to any disclaimer, the term of this patent is extended or adjusted under 35 U.S.C. 154(b) by 995 days.

(21) Appl. No.: 10/490,093

(22) PCT Filed: Aug. 20, 2002

(86) PCT No.: PCT/EP02/09287

§ 371 (c)(1),
(2), (4) Date: Oct. 13, 2004

(87) PCT Pub. No.: WO03/026980

PCT Pub. Date: Apr. 3, 2003

(65) Prior Publication Data

US 2005/0045578 A1 Mar. 3, 2005

(30) Foreign Application Priority Data

Sep. 20, 2001 (DE) ..... 101 46 817

(51) Int. Cl.
*B65D 41/34* (2006.01)

(52) U.S. Cl. ..... 215/252; 215/258

(58) Field of Classification Search ..... 215/252, 215/258

See application file for complete search history.

(56) References Cited

U.S. PATENT DOCUMENTS 4,494,664 A * 1/1985 Guala ..... 215/252
4,579,241 A 4/1986 Hayes
4,666,053 A 5/1987 Corcoran et al.
5,246,125 A * 9/1993 Julian ..... 215/252
5,257,705 A * 11/1993 de Santana ..... 215/252

(Continued)

FOREIGN PATENT DOCUMENTS

DE 33 23 487 A1 1/1985

(Continued)

OTHER PUBLICATIONS

International Search Report for PCT/EP02/09287; ISA/EP; Mailed: Jan. 9, 2003.

(Continued)

*Primary Examiner*—Anthony Stashick
*Assistant Examiner*—James N Smalley
(74) *Attorney, Agent, or Firm*—Harness, Dickey & Pierce, P.L.C.

(57) ABSTRACT

We propose a screw closure for containers, particularly bottles, with a top from which extends a surrounding skirt, said screw closure having a holding device for fixing the screw closure to the container, and with a security band disposed at the edge of the skirt that is facing away from the top, said security band being connected to the screw closure via a predetermined breaking line, and at least one elongation zone being provided in the security band, said elongation zone enabling the security band to extend preferably transverse to its circumferential direction. This screw closure is characterized by the fact that the security band (11) has at least one elastic region (39) that is formed by the lower part of the security band (11) between a holding strip (29) and an elastic holding band (35).

40 Claims, 5 Drawing Sheets

U.S. PATENT DOCUMENTS

| | | | | | |
|---|---|---|---|---|---|
| 5,295,600 | A | * | 3/1994 | Kowal | 215/252 |
| 5,360,126 | A | * | 11/1994 | Snyder et al. | 215/252 |
| 5,373,954 | A | * | 12/1994 | Julian | 215/256 |
| 5,657,889 | A | * | 8/1997 | Guglielmini | 215/252 |
| 5,893,474 | A | * | 4/1999 | Herrmann et al. | 215/252 |
| 6,264,052 | B1 | * | 7/2001 | Schmitz | 215/252 |
| 6,474,491 | B1 | * | 11/2002 | Benoit-Gonin et al. | 215/252 |
| 6,793,082 | B1 | * | 9/2004 | Long, Jr. | 215/252 |

FOREIGN PATENT DOCUMENTS

| | | | |
|---|---|---|---|
| DE | 42 07 996 | A1 | 9/1993 |
| EP | 0 514 566 | | 11/1992 |
| EP | 0 514 566 | A | 11/1992 |
| EP | 0 537 530 | | 4/1993 |
| EP | 0 537 530 | A | 4/1993 |
| EP | 0 552 958 | | 7/1993 |
| EP | 0 552 958 | A | 7/1993 |
| WO | 94/14674 | | 7/1994 |

OTHER PUBLICATIONS

International Preliminary Examination Report for PCT/EP02/09287; IPER/EP; Date of Completion: Feb. 20, 2004.
Search Report from the Chilean Patent Office.

* cited by examiner

SCREW CAP

CROSS-REFERENCE TO RELATED APPLICATIONS

This application is a National Stage of International Application No. PCT/EP02/09287, filed Aug. 20, 2002 which claims benefit of German patent application number 101 46 817.2, filed Sep. 20, 2001.

FIELD OF THE INVENTION

The invention relates to a screw closure for containers, particularly bottles.

BACKGROUND OF THE INVENTION

Screw closures of the kind addressed herein are known. They either present an inner thread that meshes with the outer thread of a container or they are bayonet locks. In both cases, it is critical that to be opened the screw closure undergo a certain rotatory motion and particularly an axial transverse motion, whereby the closure is lifted from the container or its mouth. It is known to provide such screw closures with a security band, also known as warranty band, which upon the first opening, namely when the screw closure is taken off the container for the first time, is deformed or destroyed in certain regions so that the outer contour is changed. As a result of the changed outer contour, a user can immediately recognize that the container is no longer closed in the original manner and that it possibly has been tampered with. It has been found that the first opening of a screw closure requires rather high opening forces, to prevent easy opening of the closure. Moreover, for many closures of this kind the force needed to reclose the container is relatively high. Finally, in many cases the deformed security band interferes with reclosure. In the known closures, the warranty band is connected to a predetermined breaking line extending all around in the circumferential direction and is provided with a separation line extending vertically thereto. When the closure is opened for the first time, the predetermined breaking line is split in some parts, and the separation line opens up.

SUMMARY OF THE INVENTION

To reach this objective, we propose a screw closure having the features indicated in claim 1. It comprises a top from which extends a surrounding skirt which on its inside is provided with a holding device for fixing the screw closure to the container. As mentioned hereinabove, this device can be in the form of a thread or optionally a bayonet lock. As a rule, the screw closure is provided with an internal thread that cooperates with an outer thread on the container. The screw closure is additionally fitted with a security band disposed at the edge of the skirt facing away from the top and which is connected to the screw closure through a predetermined breaking line. The screw closure is characterized by the fact that the security band is provided with at least one elongation zone the extension behavior of which is clearly different from that of the remainder of the security band: The security band is resilient in the region of the elongation zone, particularly across its longitudinal extension, namely across the circumferential direction, so that it exhibits higher flexibility. As a result, less force is needed for the first opening of the screw closure. The same is true for the reclosing of the screw closure. During the first opening, the elongation zone is deformed so that the security band does not interfere when the container is again closed. In this regard, the security band has as a distinguishing feature a closed structure, namely in the undamaged condition it forms a closed band so that during the first closing of the screw closure cannot get interlocked anywhere. The closed band is characterized by high stability despite the elongation zone so that during the first closing of a container the security band remains undamaged with the highest reliability and interference with the closing procedure is practically eliminated. The elongation zone has the distinguishing feature that it confers extensibility to the security band, particularly in the direction perpendicular to the circumferential direction of the screw closure, namely perpendicular to the longitudinal direction of the security band, in other words in the direction of the height of the security band.

In a preferred embodiment of the screw closure, the elongation zone extends essentially horizontally. This permits relatively easy and thus inexpensive fabrication of the elongation zone.

Preferred is a screw closure with the distinguishing feature that the elongation zone is displaced relative to the predetermined breaking line in the circumferential direction. As a result of this arrangement, there is at least one region, referred to as the overlap region, wherein there is present a predetermined breaking line as well as an elongation zone, said line and said zone being disposed at a distance from each other as seen over the height of the security band. In this manner, an elastic holding band is formed which extends from at the edge of the skirt facing away from the top and as far as the lower region of the security band. The elastic holding band stabilizes the security band relative to the skirt thus keeping the skirt in a desired position. The forces needed for reclosure are thus adjustable, and interference during reclosure can be avoided.

Also preferred is an embodiment of the screw closure that is provided with several elongation zones in the region of the security band. In this manner, it is possible to influence the elasticity of the security band in a specific manner so that the opening and reclosing forces can readily be adjusted to a desired low value.

Particularly preferred is an embodiment of the screw closure wherein a cut is provided in the region of the security band, namely an elongation cut that acts as an elongation zone. In the region of the cut, which can be intermittent and which entirely or partly passes through the thickness of the security band, the security band has higher elasticity or extensibility so that the elongation zone can be fabricated in simple manner.

In another embodiment of the screw closure, the predetermined breaking line does not extend all the way around. In this manner, it is possible to obtain a holding region, referred to as a holding strip, that holds the security band in the desired position.

Another preferred embodiment of the screw closure has the distinguishing feature that in the region of the security band, namely between the predetermined breaking line and the edge of the security band facing away from top of the screw closure, there is provided at least one weakening zone preferably extending essentially vertically. It is also conceivable for said weakening zone to be disposed at an angle to the vertical direction. It is essential that in the region of the weakening zone the security band exhibit reduced strength to enable deformation and possibly splitting of the security band to occur in the weakening zone during the first opening.

Particularly preferred is an embodiment of the screw closure wherein the weakening zone presents weakening regions that are displaced relative to each other in the circumferential direction. Between the two weakening regions is a connecting strip the strength of which is determined by the length of the weakening regions and by the extent of the displacement. In this manner, the strength in the region of the weakening zone can be predetermined without any particular effort.

Other embodiments of the invention are covered in the remaining subclaims.

BRIEF DESCRIPTION OF THE DRAWINGS

In the following, the invention will be explained in greater detail by way of the drawings in which.

DETAILED DESCRIPTION OF THE PREFERRED EMBODIMENTS

Figure 1:
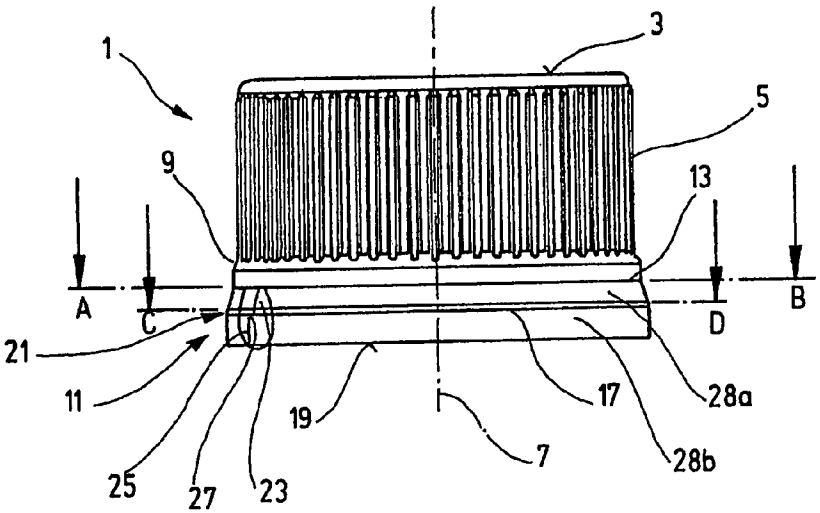
FIG. 1 shows a first embodiment of a screw closure in undamaged condition.

The screw closure described in the following has the distinguishing feature that it is lifted from the container mouth during the first opening, namely that it undergoes a transverse motion in addition to the rotatory one. On the inside of the security band is provided an interlocking arrangement that cooperates with an abutment on the container that is to be closed. In this manner, a force is applied to the security band which, on the one hand, acts parallel to the transverse motion and, on the other, brings about a radial widening of the security band.

The first embodiment of a screw closure 1 has a top 3 that spans the mouth of the container that is to be closed and from which skirt 5 extends all around so that, overall, a cup-shaped screw closure 1, also referred to as a screw cap, is formed. On the outside of skirt 5, there can be provided, as shown here, ribs extending vertically, namely in parallel with the central or rotation axis 7 of screw closure 1, for the purpose of increasing the ease of gripping screw closure 1. At edge 9 of skirt 5 that faces away from top 3 there is provided a security band 11 connected to skirt 5 through a predetermined breaking line 13. Said line is made so that during the first opening security band 11 is detached from skirt 5 in some regions. As a rule, a weakening region is provided or a cut line is made in the wall of the screw closure, namely in the region between skirt 5 and security band 11, said weakening region or cut line extending through the wall over the entire thickness or only a part of the thickness of security band 11. If the cut extends over the entire thickness of security band 11 then, as a rule, there are provided several connectors 15 (see FIGS. 2 and 3) which when the cut is made remain essentially undamaged and which span predetermined breaking line 13. During the first opening, these connectors 15 are torn off so that the predetermined breaking line 13 opens up.

The predetermined breaking line 13 can also extend over the entire periphery of screw closure 1. Preferably, however, it extends over a smaller part of the periphery, for example one amounting to about 240°. Conceivably, it is possible to provide several predetermined breaking lines 13 separated from one another and each extending over a smaller part of the periphery.

At a distance from edge 9, there is provided beneath predetermined breaking line 13 inside security band 11 and approximately parallel to predetermined breaking line 13, an elongation zone 17 in the region of which the extensibility of security band 11 is substantially higher than in the neighboring region. When—seen in the circumferential direction—there are provided several predetermined breaking lines, then preferably at least one elongation zone 17 is to be assigned to each predetermined breaking line. Elongation zone 17 preferably consists of a linear softer or weakened region of security band 11 and preferably of an elongation cut. This cut can be a through-cut or an intermittent one consisting of individual cut lines. The depth of the cut is selected so that it extends either only through part of the thickness or through the entire thickens of security band 11, in which case it is necessary to provide a connecting bridge that spans the cut and is torn during the first opening.

Elongation zone 17 has the distinguishing feature that—as seen in the circumferential direction—it extends at least over a certain partial region of screw closure 1. When the closure is opened for the first time, elongation zone 17 is subjected to a force so that it widens essentially transverse to its long dimension. The elongation zone thus extends essentially transverse to the long dimension or circumferential direction of security band 11, namely in the direction of the height of security band 11 or in the direction of rotation axis 7.

It can be seen from FIG. 1 that in the embodiment presented here elongation zone 17 extends essentially horizontally and thus practically parallel to predetermined breaking line 13 and/or to the edge 19 of security band 11 facing away from the border. Conceivably, elongation zone 17 can also follow an imagined helical line.

FIG. 1 shows that the screw closure is provided with a weakening zone 21 which here comprises a first weakening region 23 disposed between predetermined breaking line 13 and elongation zone 17 and a second weakening region 25 disposed between elongation zone 17 and edge 19.

Weakening zone 21 has the distinguishing feature that its strength is lower than that of the remaining regions of security band 11. Hence, during the first opening, said security band can stretch or preferably break in the region of weakening zone 21.

In the embodiment presented here, weakening zone 21 extends essentially vertically, namely parallel to rotation axis 7. It can, however, also be more or less inclined toward said axis. In the embodiment presented here, said zone is—as stated—divided into two weakening regions. These regions—as seen in the circumferential direction—are somewhat displaced, namely they do not form a weakening region that extends vertically through. This is not absolutely necessary. In other words, optionally only a single passing-through weakening region may be provided. Weakening zone 21 can thus consist of several vertical weakening regions or of a single passing-through weakening region. Weakening zone 21 can be in the form of a linear weakening region, namely a thin-walled region, or preferably in the form of a weakening cut or weakening cuts constituting weakening regions 23 and 25. The cuts can pass through the entire thickness of security band 11 or they can pass through only a part thereof. Conceivably, interrupted, intermittent cuts can also be provided. It is also possible to provide a through-passing cut spanned by a bridge that is torn during the first opening of closure 1.

To reach a defined strength, it is possible, as shown here, to provide two vertical, displaced weakening regions 23 and 25 between which is retained a connecting strip 27 connecting the upper part of security band 11 to its lower part. By the distance seen in the circumferential direction and by the length of weakening regions 23 and 25 as seen in the vertical direction, the strength of connecting strip 27 can be established in a defined manner and thus also the splitting characteristics of security band 11 during the first opening. When in the region of weakening zone 21 there are provided two mutually aligned, merging weakening regions 23 and 25, the strength in the region of weakening zone 21 can be established by the depth of the cut or by the thickness of security band 11 or else by an intermittent cut provided with at least one bridging strip.

The lateral view according to FIG. 1 shows that security band 11 has two regions between predetermined breaking line 13 and lower edge 19, namely an upper band region 28*a* and a lower band region 28*b*. Between these regions lies elongation zone 17.

Figure 2:
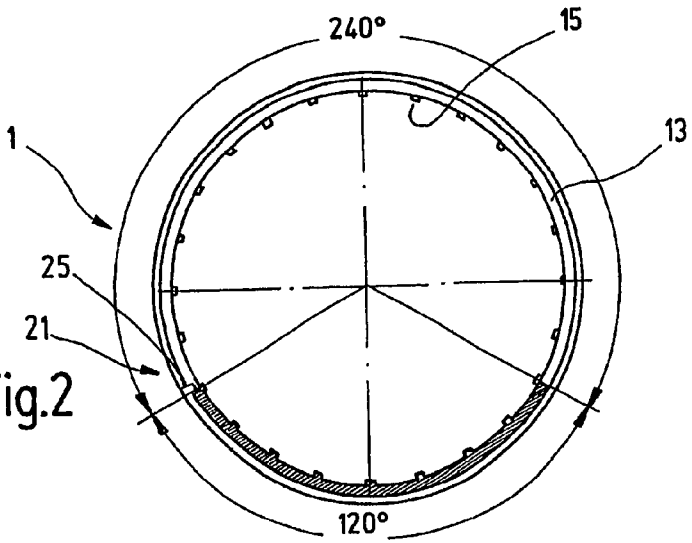
FIG. 2 is a cross-sectional view along line A-B of FIG. 1.

FIG. 2 is a cross-sectional view of screw closure 1 of FIG. 1. Identical parts bear the same re-ference numerals so that in this respect the reader is referred to the description of FIG. 1.

FIG. 2 shows that predetermined breaking line 13 does not extend all around but only around a region of about 240°. In a peripheral region of about 120°, edge 9 of screw closure 1 is not weakened or cut. In other words, here there is no predetermined breaking line 13, either. Here, in this region, skirt 5 is firmly connected to security band 11, namely to the upper band region 28*a* thereof.

Figure 3:
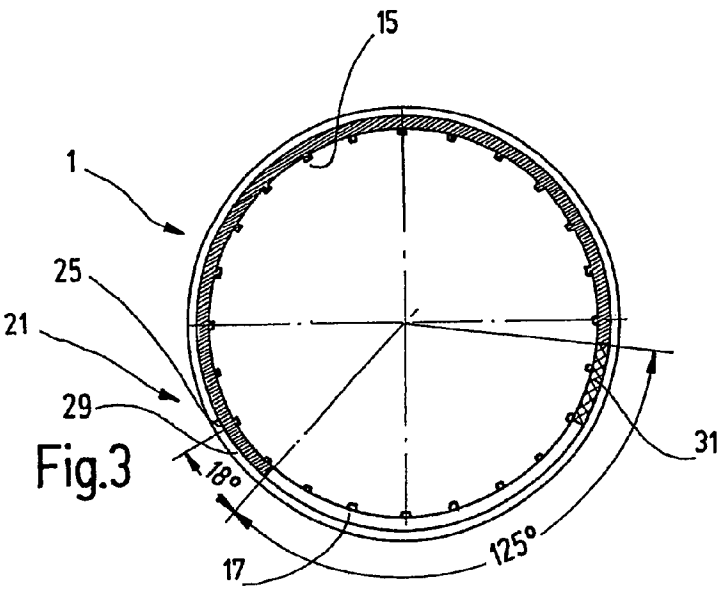
FIG. 3 is a cross-sectional view along line C-D of FIG. 1.

The cross-sectional view according to FIG. 3 shows that elongation zone 17 also does not extend all the way around. In the embodiment presented here, said zone extends over a circumferential angle of about 125°. To the left of elongation zone 17, a holding strip 29 is formed by the fact that here security band 11 has no predetermined breaking line 13 and no elongation zone 17. In other words, here security band 11 is fastened directly to edge 9 of skirt 5 of screw closure 1 or forms a single unit with it. Holding strip 29 preferably extends over a region of about 12° to 18° and particularly 15°.

Holding strip 29 extends as far as the lower band region 28*a* so that here this region is connected with skirt 5.

On the other side of elongation zone 17 that faces away from holding strip 29 there is located an overlap region 31 wherein there exists, on the one hand, predetermined breaking line 13 and, on the other, elongation zone 17 located at a distance therefrom—as seen in the direction of rotation axis 7. In this case, predetermined breaking line 13 and elongation zone 17 are disposed from one another at a distance that corresponds to the height of upper band region 28*a*.

The undamaged regions of screw closure 1 that forms holding strip 29 and overlap region 31 can be established in terms of their width, as measured in the circumferential direction, by appropriate selection of the circumferential length of predetermined breaking line 13 and elongation zone 17. The overlap extends over a region of 30° to 36° and preferably about 33° or, in other words, over a region amounting to 1/10 to ½ of the circumference.

The weakening zone 21 and particularly the second weakening region 25 can be seen in FIGS. 2 and 3.

Figure 4:
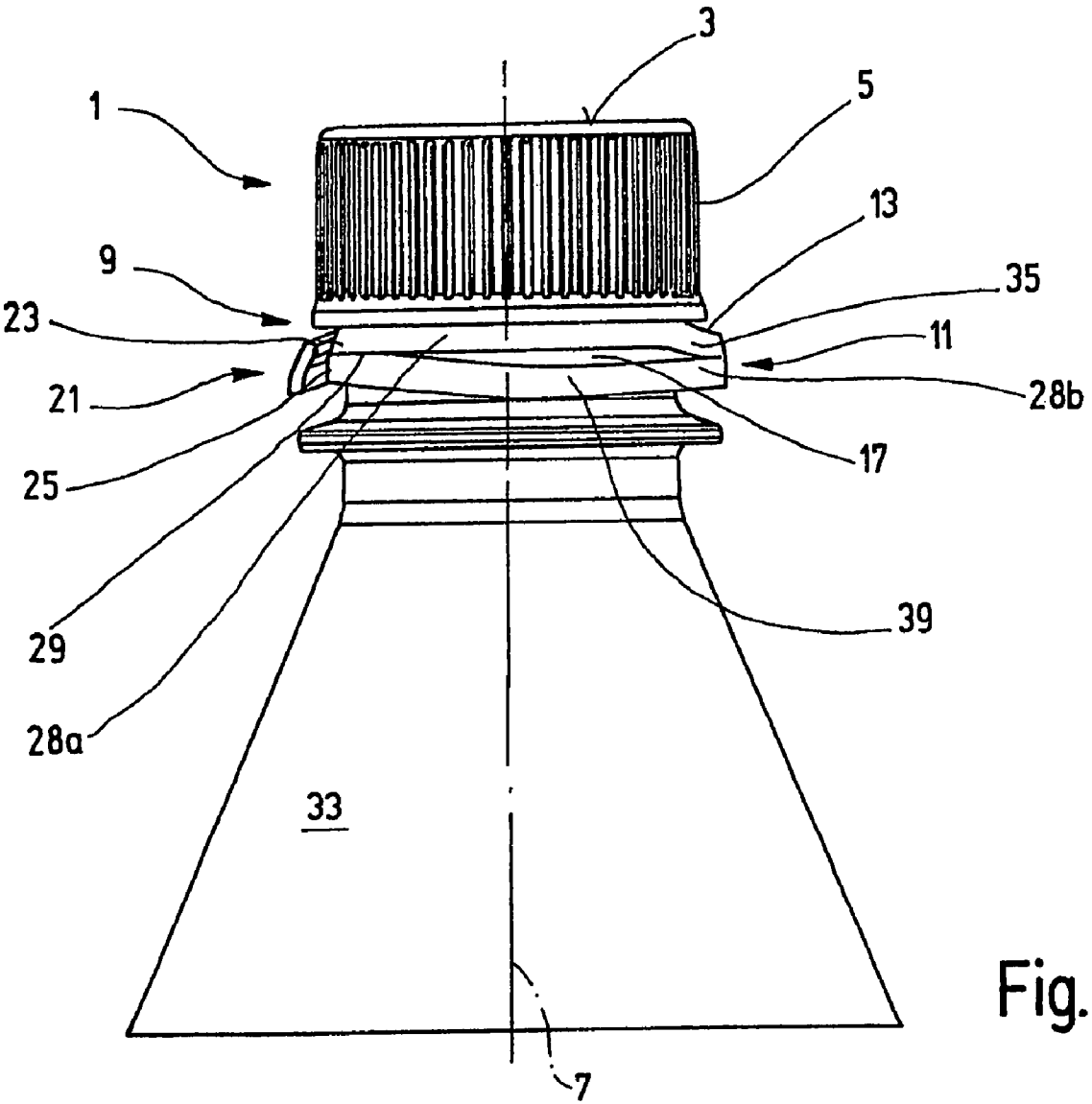
FIG. 4 shows a screw closure resting on top of a container after the first opening.

FIG. 4 shows screw closure 1 on a container, here on a bottle 33. It is evident that screw closure 1 has been opened for the first time. Parts coinciding with those shown in preceding figures are indicated by the same reference numerals. In this respect, the reader is referred to the description of FIGS. 1 to 3.

During the first opening of screw closure 1, security band 11 was torn in the region of weakening zone 21, namely in the first weakening region 23 and in the second weakening region 25 as well as in the region of predetermined breaking line 13 and elongation zone 17. In the region of predetermined breaking line 13, security band 11 is completely detached from skirt 5. It is connected to edge 9 of skirt 5 only where there is no predetermined breaking line 13, for example in the region of holding strip 29. Elongation zone 17 is slightly spread, because security band 11 was deformed during the first opening. To the left of elongation zone 17 can be seen holding strip 29 wherein the lower part of security band 11, referred to as lower band region 28*b* namely the region located below elongation zone 17, is connected with the upper part of security band 11, referred to as the upper band region 28*a*, and with it to edge 9 of screw closure 1. In the region of the right edge of elongation zone 17 formed by overlap region 31 (see FIG. 3) there is provided an elastic holding band 35 which elastically connects the lower band region 28*b* of security band 11 with the upper band region 28*a* of security band 11 and finally with skirt 5.

Elastic holding band 35 holds the split segment in the region of elongation zone 17 and the segment broken in the region of the predetermined breaking line 13 of security band 11 in a desired spread position so that the forces required for reclosure are minimized and security band 11 is held so that it does not interfere when the container or bottle 33 is reclosed with screw closure 1.

The following is quite evident. The width of holding strip 29, as seen in the circumferential direction, is defined by the distance of the left end of elongation zone 17 to weakening zone 21. The size of overlap region 31 as measured in the circumferential direction defines the length of the elastic holding band 35, and the distance between elongation zone 17 and predetermined breaking line 13 as measured in the vertical direction determines the height and thus the strength of elastic holding band 35 and, hence, also the elasticity of security band 11.

In other words, the strength of holding strip 29 and that of elastic holding band 35 can thus be established in simple manner, the selection of the material constituting security band 11, of course, also playing an essential role in this regard.

Figure 5:
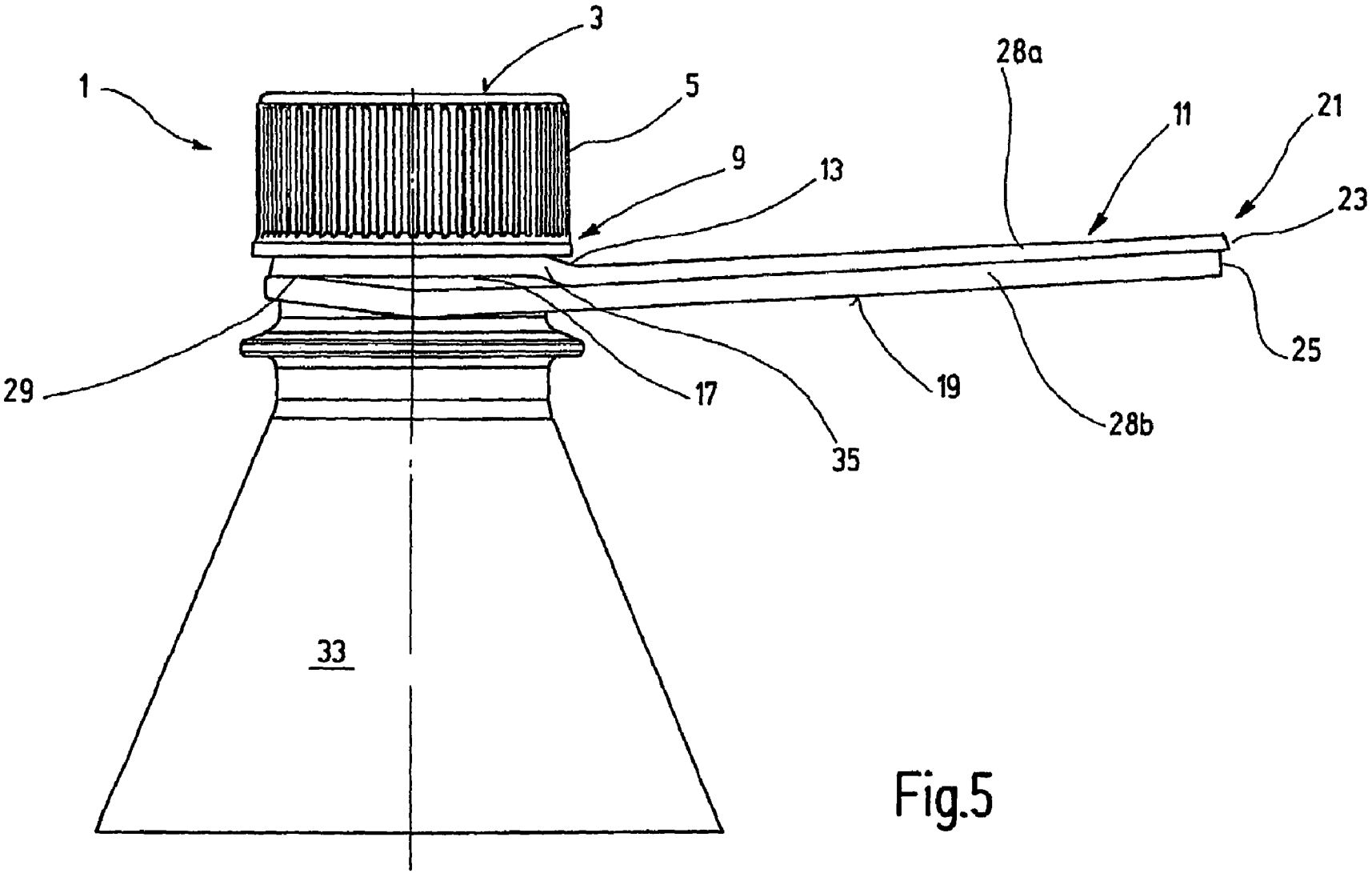
FIG. 5 depicts a screw closure on a container, the closure showing a spread security band.

FIG. 5 shows once again screw closure 1 placed on a bottle 33. Here security band 11 is bent approximately linearly against its inherent elasticity. In other words, it no longer extends along a bent contour around container 33. This arrangement of security band 11 is not the one which said band assumes in a regular functional position, but serves only to explain the configuration of screw closure 1. Identical parts are indicated by the same reference numerals so that for a description the reader is referred to the preceding figures.

Security band 11 is thus provided with two band regions. An upper band region 28*a* follows directly predetermined breaking line 13. A lower band region 28*b* reaches as far as edge 19 of security band 11. To the right of elongation zone 17, the upper and lower region of security band 11 are connected to each other or form a single unit. In other words, here there are no weakening or elongation zones.

At the right, free end of security band 11 can be seen weakening zone 21 which extends around the upper, first weakening region 23 in upper band region 28*a* and the lower, second weakening region 25 displaced in circumferential direction in the lower band region 28*b*. Both weakening regions 23 and 25 are split when screw closure 1 is opened for the first time so that here a step is almost formed. Weakening zone 21 as a rule splits already during the first opening of screw closure, and at the latest when screw closure 1 is lifted from the container mouth.

It is evident from FIGS. 1 to 5 that the outer surface of upper band region 28*a* of security band 11 as applied widens in slightly conical manner starting at skirt 5 and that lower band region 28*b* of security band 11 has a cylindrical shape. It is quite conceivable that the conical widening also extends over the lower band region 28*b* of security band 11 or that the upper band region 28*a* of security band 11 can have an essentially cylindrical shape.

The total height of security band 11 determines its strength. The height of upper band region 28*a* amounts to about one third of the total height and in particular from 0.3 to 0.33 times the total height. For a total height of security band 11 of about 4.2 mm, the height of upper band region 28*a* is then about 1.26 mm to about 1.4 mm. The connection of security band 11 to skirt 5 of screw closure 1 or to its edge 9 occurs via elastic holding band 35 and also via holding strip 29. These connections also predetermine the breaking properties of security band 11 overall and in the region of elongation zone 17 during the first opening of screw closure 1. These properties also depend on the material constituting screw closure 1.

It is important that elongation zone 17 and weakening zone 21 reduce the overall strength and increase the elasticity of security band 11 so that less strength is needed to open screw closure 1 for the first time. The elasticity of security band 11 can be influenced by the length of elongation zone 17. Moreover, the free-standing region of security band 11 is kept in spread position by elastic holding band 25 so that a first opening and thus tampering can be reliably recognized, the reclosing forces can be reduced and security band 11 does not interfere with reclosure.

Figure 6:
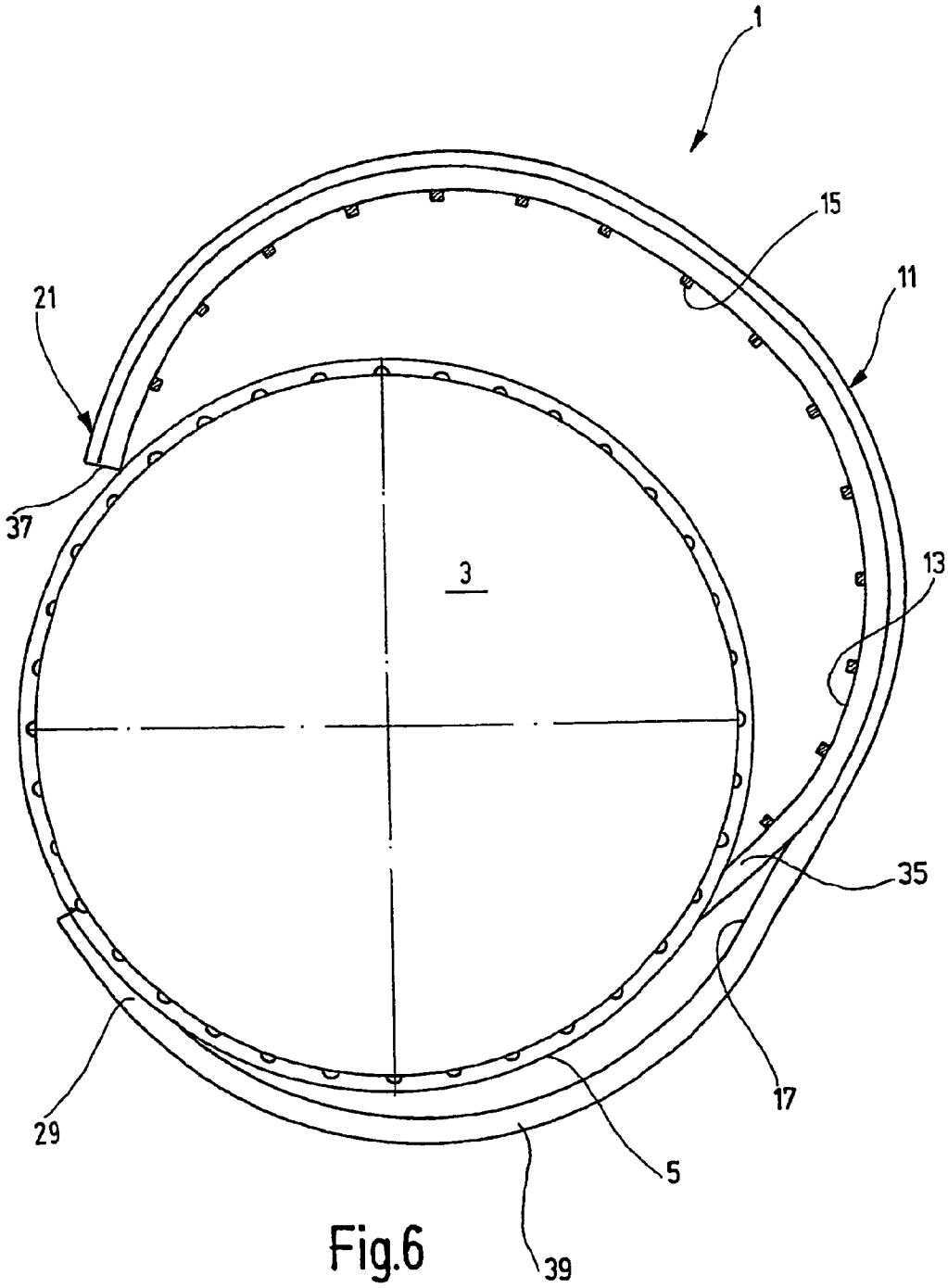
FIG. 6 shows a top view of the screw closure of FIG. 1 in the opened condition.

FIG. 6 is a top view of screw closure 1 as explained with the aid of FIGS. 1 to 5. Identical parts are indicated by the same reference numerals so that for a description the reader is referred to the preceding figures.

Screw closure 1 has already been opened so that, as shown in FIG. 4, security band 11 is radially split. This readily indicates to the user that tampering with and a first opening of screw closure 1 had taken place.

It is evident that security band 11 is spread to an extent such that it no longer interferes with the reclosure of the container. Free end 37 can support itself on the lower edge 9 of skirt 5 and is thus held reliably in the spread position. Moreover, security band 11 is kept reliably in the spread position by elastic region 39 formed by lower band region 28*b* of security band 11 between holding strip 29 and elastic holding band 35 so that already for this reason said security band does not interfere with reclosure, and the forces required for reclosure are clearly reduced. The elasticity of the fixed, elastic region 39 is determined by the length of elongation zone 17 and/or the axial distance of elongation zone 17 from edge 9 of security band 11.

The reason why security band 11 is held very well in the spread position by elastic region 39 is that at one of its ends elastic region 39 is supported at holding strip 29, namely it is also connected directly with skirt 5 of screw closure 1.

The purpose of elastic holding band 35 is, on the one hand, also to hold security band 11 in a more or less spread position, as can be seen from FIG. 6. On the other hand, however, it also serves to maintain the spreading in the region of elongation zone 17 that occurred during the first opening, as can be seen from FIG. 4. In this case, as shown in FIG. 4, the lower band segment 28*b* of security band 11, namely elastic region 39, is kept at a distance from its upper band region 28*a* so that by this axial spreading, too, tampering with and a first opening of screw closure 1 can readily be recognized by a user.

Unlike in FIG. 6, security band 11 can with its free end 37 also lie slightly inside the outer boundary line of screw closure 1. It is essential that said band be held over its entire length at a radial distance from skirt 5 of screw closure 1 so that the interlocking and fastening devices, not shown here, disposed on the inside of security band 1 and which can have the form of barbs do not interfere with reclosure of the container and the reclosing forces are thereby substantially reduced. The fastening devices can be oriented and disposed relative to predetermined breaking line 13 and particularly relative to elongation zone 13 so that security band 1 is stabilized during the first attachment of screw closure 1 and during transport of the closed container.

It can thus be seen from FIG. 6 that elastic region 39 is held at a radial distance from skirt 5. The distance of the remaining security band 11 can be increased further in the radial direction by the spreading forces of elastic region 39 and by the holding forces of elastic holding band 35. We found that the barbs provided on the inside of security band 11 are in their original position only in the region of holding strip 29. The barbs on the inside of elastic region 39 and on the inside of the remaining security band 11 are displaced radially outward. As a result, as already stated, during closing, namely while the closure is being screwed on, the barbs of screw closure 1 cannot interfere and the reclosure forces are clearly reduced.

Figure 7:
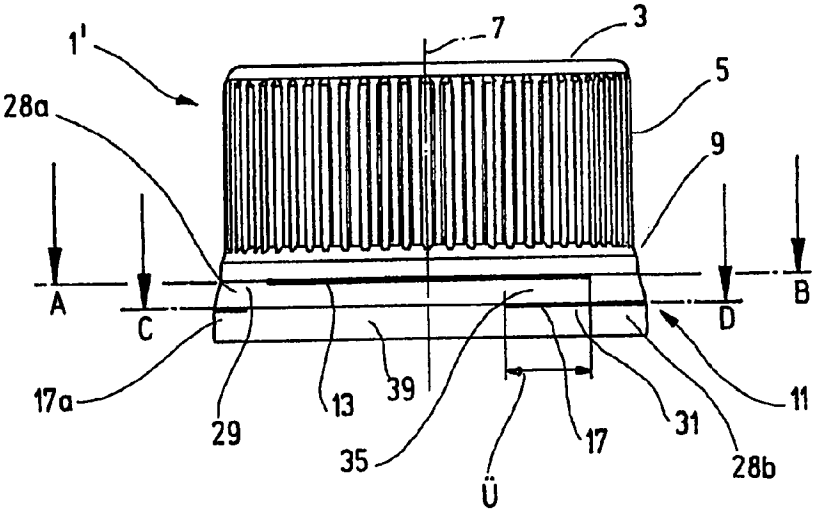
FIG. 7 shows a side view of a second embodiment of a screw closure in undamaged condition.

FIG. 7 shows a modified embodiment 1' of the screw closure, similar to the one explained by way of FIGS. 1 to 6. Identical parts are indicated by the same reference numerals so that for a description the reader is referred to the preceding figures.

Screw closure 1' also has a top 3 from which extends skirt 5. On edge 9 of said skirt, facing away from top 3, is attached a security band 11 which via a predetermined breaking line 13 is connected to edge 9 and has an elongation zone 17. In the embodiment of screw closure 1' presented here, as in the embodiment presented hereinabove, predetermined breaking line 13 does not have to extend all the way around and—and this also applies to the above-described embodiment—several individual segments of a predetermined breaking line can be provided. The same is also true for elongation zone 17 in both embodiments. In other words, in both embodiments there can be provided one or more elongation zones 17 as will be explained in greater detail by reference to FIGS. 8 and 9.

Figure 9:
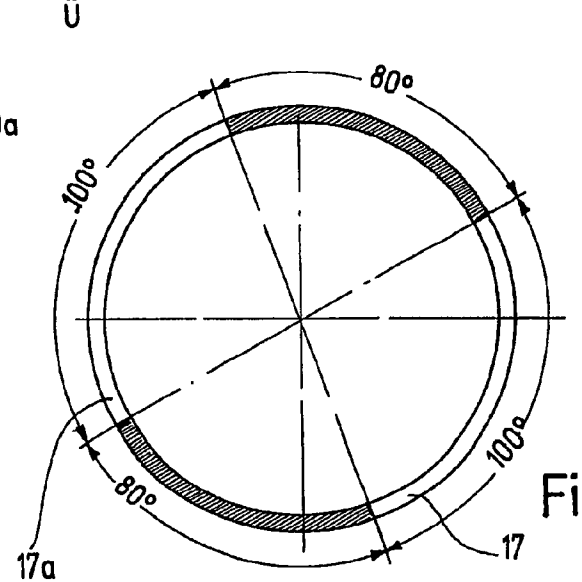
FIG. 9 shows a cross-section of the screw closure shown in FIG. 6 along line C-D.
Figure 8:
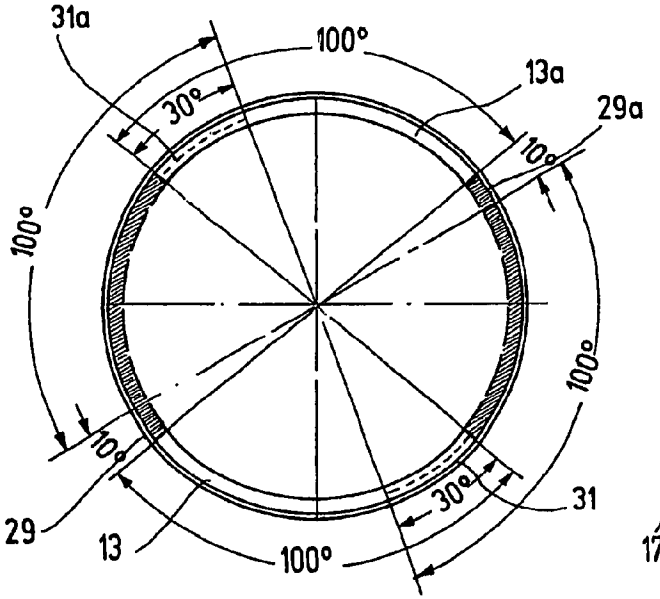
FIG. 8 shows a cross-section along line A-B indicated in FIG. 6.

The essential difference of the embodiment of screw closure 1' presented in FIGS. 7 to 9 is that it does not have a weakening zone which in the afore-described embodiment is identified by reference numeral 21.

In the embodiment presented here, predetermined breaking line 13 extends essentially horizontally, as does elongation zone 17. For this embodiment, as for the afore-described one, however, the predetermined breaking line and the elongation zone can extend at an angle inclined toward the horizontal or they can follow an imagined helical line. It is essential that predetermined breaking line 13 and elongation zone 17 intersect in a region Ü, namely that an overlap region 31 is formed, as was already explained by way of FIG. 3. The length of the intersection in region Ü, indicated by a double-headed arrow, can be selected within a wide range as can the axial distance, as measured in the direction of rotation axis 7, between predetermined breaking line 13 and elongation zone 17. As a result of this configuration, here, too, an elastic band 35 is formed which after the first opening of screw closure 1' connects an upper band region 28*a* of security band 11 with the lower band region 28*b* and which after the first opening holds the lower band region 28*b* of security band 11 in a spread position as can be seen in FIG. 4. Lower band region 28*b* of security band 11 is thus radially spread and disposed at a distance from the upper band region. Moreover, elongation zone 17 is kept in the spread condition so that tampering and a first opening are readily recognizable.

A second elongation zone 17*a* can be seen at the left end of predetermined breaking line 13 presented in FIG. 7. In principle, first elongation zone 17 could extend around a length which would make elongation zone 17*a* its second end, namely the end of elongation zone 17 facing away from overlap region 31. Here, however, it has been assumed—as can be seen in FIG. 9—that two elongation zones 17 and 17*a* are present. The right-hand end of elongation zone 17*a* does not intersect the left-hand end of predetermined breaking line 13 so that here the lower band region 28*b* of security band 11 is connected, via its upper band region 28*a*, with edge 9 of skirt 5 of screw closure 1' thereby forming holding strip 29. By means of holding strip 29, the lower band region 28*b* can, as described hereinabove, be supported reliably on skirt 5 so that the desired spreading forces are ensured.

Screw closure 1' is similarly configured on the opposite side, namely on the side hidden in FIG. 7. This means that elongation zone 17*a* has a region 31 where it overlaps with a second predetermined breaking line, not shown, so that here, too, an elastic holding band 35*a* is formed. In other words, there can be provided several elongation zones disposed at a distance from each other in the circumferential direction. Here, as in the first embodiment, it is possible to provide several elongation zones distributed over the height of security band 11.

FIG. 8 is a cross-sectional view of screw closure 1' along line A-B of FIG. 7. It can be seen here that the predetermined breaking line 13 shown in FIG. 7 extends in this case over a circumferential region of, for example, about 100°. On the opposite side there is provided a centrosymmetric predetermined breaking line 13*a*.

At one end, here the right end, of predetermined breaking line 13, 13*a* there is provided overlap region 31, 31*a* which in this case extends over a region of, for example, about 30°. It is shown in FIG. 8 that over a region of about 10° there is no intersection between predetermined breaking line 13, 13*a* and elongation zone 17, 17*a* so that holding strip 29, 29*a* is formed.

FIG. 9 shows a cross-section of screw closure 1' along line C-D of FIG. 7. Here it can be seen that elongation zones 17 and 17*a* extend over a circumferential region of about 100° and that they are disposed symmetrically relative to one another.

Overall, the following is obvious. In both embodiments of screw closures 1, 1', security band 11, which via a predetermined breaking line 13 is connected to edge 9 of skirt 5, is provided with at least one elongation zone 17. Predetermined breaking line 13, which does not extend all the way around, in some regions intersects elongation zone 17 which, too, does not extend all the way around, so that there is provided at least one overlap region 31. Through elongation zone 17, security band 11 in this fixed, namely radially not freely spread region, is provided with an elasticity that facilitates the reclosure of a container. In overlap region 31 is formed an elastic holding band 35 that holds security band 11 after the first opening of screw closure 1, 1'. On the one hand, by means of elastic holding band 35, in the region of elongation zone 17, a lower elastic region 39 of security band 11 facing away from skirt 5 is kept in spread position at an axial distance from the upper region of security band 11. On the other hand, elastic holding band 35 can hold a security band 11 spread in the circumferential direction at a radial distance from skirt 5.

Security band 11 is spread particularly when a weakening zone 21 is provided, as explained for the embodiment presented by way of FIGS. 1 to 6. But even without such a weakening zone, as explained for the embodiment presented in FIGS. 7 to 9, and without the spreading of security band 11, elongation zone 17 in security band 11 provides a reliable indication of tampering with and first opening of screw closure 1. Moreover, in all embodiments, security band 11 is weakened by elongation zone 17 so that the additional extension reduces the forces required for a first opening as well as those required for reclosure.

Beneath elongation zone 17 of both screw closures 1 and 1', in the lower band region 28*b*, there is formed elastic region 39 which not only is spread axially but also radially, as explained in greater detail by reference to FIG. 6. By this radial spreading, in both embodiments the barbs located on the inner surface of elastic region 39 are also displaced radially outward so that they cannot interfere with the reclosure of a container. At the least, the forces for reclosure are much reduced.

It can also be seen from FIG. 4 that the lower band region 28*b* located below elongation zone 17, namely, in particular, elastic region 39 is swiveled downward. By the connection of elastic region 39 to holding strip 29, on the one hand, and to elastic band 35, on the other, a tilting motion results whereby the barbs located on the inner surface of elastic region 39 are also swiveled. Also as a result of this swiveling, the barbs do not interfere with the reclosure of a container, and at least the forces required for reclosure are reduced.

The basic principle of the additional elongation zone described here, as explained by way of FIGS. 1 to 6, is realized with a single elongation zone 17. It is also possible, however, to provide several elongation zones as seen in the circumferential direction and over the height of security band 11, as explained by reference to FIGS. 7 to 9, and which also applies to screw closure 1. When several elongation zones 17 are provided over the height of security band 11, then overlap regions can be provided between them so that, correspondingly, several elastic holding bands also are formed. It is also possible that at one or more elongation zones at both ends there are overlaps with the predetermined breaking line and/or the elongation zones so that elastic holding bands are formed on both sides. Such an arrangement provides especially high extensibility of security band 11 in the direction of the rotating axis of screw closure 1, namely over the height of security band 11. Here, the aforedescribed support of an elastic region 39 is, of course, not as strong. In other words, in this case the spreading can be reduced if the holding strips are not reinforced. The horizontal regional support of security band 11 by one or, in particular, several elongation zones, can bring about increased extensibility in radial and circumferential direction whereby the first opening and the reclosure are additionally facilitated.

The advantages of screw closure 1 and 1' described here arise particularly when a weakening zone 21 is provided which extends essentially transverse to the extension of security band 1, namely in the vertical direction. In this case, one or more weakening regions can be provided. In the embodiment of FIGS. 1 to 6, two weakening regions 23 and 25 have been explained. The splitting of security band 11 in the region of weakening zone 21 causes an additional splitting in radial direction which makes it very easy to recognize a first opening and tampering. It is evident from embodiment 1', however, that weakening zone 21 optionally can also be omitted without losing the advantages of the additional elongation zone. Tampering and first opening are reliably indicated also by the axial deformation or widening of security band 11 alone. The reliability of such indication is further increased by the fact that a radial widening takes place Expansion zone 17 and optionally 17*a* can be formed in any desired manner. Conceivable is a linear weakening of the material. In particular, however, an elongation cut in security band 11 is provided. The same is true for predetermined breaking line 13 which can be made in screw closure 1, 1', but preferably consists of a cut line. In both the case of predetermined breaking line 13 and elongation zone 17 or 17*a*, the cut can penetrate through the entire thickness of security band 11 or only through part of it. Conceivably, intermittent cuts, namely successive cut lines, can be made to provide the predetermined breaking line or elongation zone.

The same is true for the weakening zone 21 which can have one or more weakening regions. Note also that unlike in the embodiment explained by reference to FIGS. 1 to 6, there can be provided several such weakening zones 21. The segments of the split security band 1 formed during the first opening are then formed in a manner similar to the security band that was explained by reference to FIGS. 1 to 6. Hence, the number of elongation zones must be adapted to the number of weakening zones in order to be able to form at least one holding strip and at least one elastic holding band for each security band region.

From all this, it is evident that holding strip 29 which cooperates with elastic region 39, is of critical importance for the advantages described here. Via holding strip 29, elastic region 39 can be supported directly on skirt 5 of screw closure 1 so that, on the one hand, elastic region 39 is held in its axially as well as radially spread position. On the other hand, by elastic region 39 being supported on holding strip 29, it can be ensured that the remaining region of security band 11 will be held in a spread position. In this manner, as described, the barbs on the inside of security band 11 are kept at a distance such that the forces needed to reclose a container are greatly reduced.

The function of holding strip 29 can also be seen in connection with weakening zone 21: Holding strip 29 holds security band 11 attached to skirt 5 in the region of weakening zone 21 so that during the first opening of screw closure 1 weakening zone 21 is reliably split or weakened to the extent that it will break the first time screw closure 1 is removed. The strength of holding strip 29 is ensured by the fact that on the side facing weakening zone 21 of holding strip 29, the horizontal predetermined breaking line 13 that spans weakening zone 21 extends into holding strip 29 only in a very small region. Preferably, care is taken that predetermined breaking line 13 extends into holding strip 29 only just a little so that the region of holding strip 19 weakened by predetermined breaking line 13 amounts to a maximum of 1/60 of the circumference of screw closure 1. If predetermined breaking line 13 penetrates further into holding strip 29, then during the first opening of screw closure 1, the region of holding strip 29 facing weakening zone 21 could be bent away downward so that weakening zone 21 would not split reliably. For this reason, the region weakened by predetermined breaking line 13 in the region of holding strip 29 is limited to the above-indicated value.

On the other side of holding strip 29, namely on the side facing away from weakening zone 21, elongation zone 17 penetrates slightly into holding strip 29. In other words, said strip is weakened, on the one hand, by a small region of predetermined breaking line 13 and, on the other, by a region of elongation zone 17 extending into holding strip 29. It is necessary to ensure that in the region of holding strip 29 the predetermined breaking line 13 and elongation zone 17 are disposed at such a distance from one another that during the first opening holding strip 29 does not break. The distance from the first weakening region 23 of weakening zone 21 to elongation zone 17 amounts to 1/20 to 1/30 of the circumference of screw closure 1, as measured in the circumferential direction. By the afore-indicated minimal residual width of holding strip 29, it is also ensured that holding strip 29 can provide sufficient holding forces for elastic region 39.

Preferably, screw closure 1, 1' is made of a plastic material and particularly by the compression molding or injection molding process. This embodiment has the distinguishing feature that the screw closure then consists entirely of a plastic material. It is also possible, however, to combine a security band 11 made of plastic material with a screw closure the top and skirt of which consist of a deep-drawable material, particularly of metal. Aluminum has been found particularly well suited for screw closures of the kind discussed here. The security band can be connected in the known manner with the edge of the skirt facing away from the top and can be configured as explained with reference to FIGS. 1 to 9. In an embodiment of this kind, too, it is possible to realize the advantages described herein even if security band 11 consists of a plastic material.

Screw closure 1, 1' described herein is suitable for disposable as well as reusable containers of all kinds made of glass, PET and the like, and particularly for bottles.

The invention claimed is:

1. A screw closure for containers with a top from which extends a surrounding skirt, said screw closure comprising:

a holding device for fixing the screw closure to the container; and a security band positioned on the edge of the skirt facing away from the top and which is connected to the screw closure via a predetermined breaking line, said security band being provided with at least one elongation zone preferably enabling the security band to extend across its circumferential direction, said security band being further provided with an upper region and a lower region, the elongation zone being located between said upper and said lower region of said security band, and the security band further having at least one elastic region that is formed by the lower part of the security band between a holding strip and an elastic band;

wherein said holding strip is formed by a first portion of said security band and connects the upper region and the lower region to the skirt to retain the upper region and the lower region on the skirt when the screw closure is completely separated from the container, said first portion being free of both predetermined breaking lines and elongation zones, and wherein said elastic band is formed by a second portion of said security band, said second portion being provided with the predetermined breaking line and the elongation zone.

2. The screw closure according to claim 1, wherein the elongation zone extends essentially horizontally.

3. The screw closure of claim 1, wherein the elongation zone extends essentially parallel to the predetermined breaking line and/or to the edge of the security band that is facing away from the top of the screw closure.

4. The screw closure of claim 1, wherein the elongation zone extends along an imagined helical line.

5. The screw closure of claim 1, wherein the at least one elongation zone is displaced in the circumferential direction relative to the predetermined breaking line.

6. The screw closure of claim 1, wherein the at least one elongation zone comprises several elongation zones.

7. The screw closure of claim 1, wherein the predetermined breaking line and/or the elongation zone are disposed at a distance from each other—as seen in the circumferential direction and/or or in the direction of the height of the security band.

8. The screw closure of claim 1, wherein the at least one elongation zone is essentially linear.

9. The screw closure of claim 1, wherein between the predetermined breaking line and at least one elongation zone and/or between several elongation zones that are displaced in the direction of the height there is provided in each case at least one overlap region and that in each case there is formed at least one elastic holding band.

10. The screw closure of claim 1, wherein at least one elongation zone is configured as an elongation cut.

11. The screw closure of claim 1, wherein the security band is connected directly to the edge of the skirt, preferably in a holding region realizable by a holding strip.

12. The screw closure of claim 1, wherein the predetermined breaking line is realizable via a weakening zone and/or a cut line.

13. The screw closure of claim 1, wherein in the region between the predetermined breaking line and the edge of the security band that is facing away from the top of the screw closure there is provided at least one, preferably vertically extending, weakening zone.

14. The screw closure of claim 13, wherein the weakening zone has a first weakening region extending between the predetermined breaking line and the elongation zone.

15. The screw closure of claim 14, wherein the weakening zone has a second weakening region extending between the elongation zone and the edge of the security band.

16. The screw closure of claim 15, wherein the first and the second weakening region merge into one another.

17. The screw closure according to claim 15, wherein the first and the second weakening region are displaced relative to each other as seen in the circumferential direction.

18. The screw closure according to claim 13, wherein the weakening zone is configured intermittently.

19. The screw closure according to claim 13, wherein the weakening zone is disposed at a distance from an elongation zone.

20. The screw closure according to claim 19, wherein a holding strip is disposed between the weakening zone and the elongation zone.

21. The screw closure according to claim 1, wherein the holding strip connects the upper band region and preferably also the lower band region to the skirt.

22. The screw closure according to claim 1, wherein the elastic region is supported by the skirt via the holding strip.

23. The screw closure according to claim 1, wherein in the region between the weakening zone and the elongation zone the security band is connected directly to the skirt, preferably via a holding strip.

24. The screw closure according to claim 13, wherein the weakening zone is essentially linear.

25. The screw closure according to claim 13, wherein the weakening zone is provided with a weakening cut.

26. The screw closure according to claim 25, wherein the weakening cut passes through the thickness of the security band.

27. The screw closure according to claim 25, wherein the weakening cut passes through a part of the thickness of the security band.

28. The screw closure according to claim 1, wherein the security band is made of a plastic material.

29. The screw closure according to claim 1, wherein said closure is made of a plastic material and/or a metal, preferably aluminum.

30. The screw closure according to claim 1, wherein the screw closure and/or the security band can be made by the compression molding or injection molding process.

31. The security band of claim 1, wherein the first portion of the holding strip extends axially across the security band.

32. A security band in combination with a screw closure for a container, the screw closure having a top and a downwardly extending skirt, the security band comprising:

an upper band member coupled to the screw closure at a predetermined break line;

a lower band member disposed below the upper band member;

an elongation zone disposed between the upper band member and the lower band member;

a holding strip vertically connecting the upper and lower band members such that the upper and lower band members are coupled to the skirt;

the holding strip including an axis extending through the upper band member, the lower band member, and the skirt and substantially parallel to a rotational axis of the screw closure to maintain a connection between the upper band member, the lower band member, and the skirt along the axis of the holding strip when the screw closure is completely separated from the container;

an elastic band elastically connecting the lower band member and the upper band member and elastically connecting the upper band member and the skirt; and at least one elastic region formed by the lower band member between the holding strip and the elastic band.

33. The security band of claim 32, further comprising a weakening zone disposed between the predetermined break line and the elongation zone, the weakening zone having a strength less than remaining regions of the security band such that during a first opening of the screw closure the security band deforms at the weakening zone.

34. The security band of claim 33, wherein the weakening zone extends vertically.

35. The security band of claim 32, wherein the holding strip extends over a region of about 12° to 18°.

36. The security band of claim 32, wherein the elastic holding band holds the upper and lower band members in a desired spread position after the first opening of the screw closure to reduce forces for re-closure.

37. The security band of claim 33, wherein the elongation zone and the weakening zone reduce an overall strength and increase on elasticity of the security band.

38. The security band of claim 32, wherein the first portion of the holding strip extends axially the security band.

39. A screw closure for containers with a top from which extends a surrounding skirt, said screw closure comprising:

a holding device for fixing the screw closure to the container; and a security band positioned on the edge of the skirt facing away from the top and which is connected to the screw closure via a predetermined breaking line, said security band being provided with at least one elongation zone such that the security band extends across a circumferential dimension, said security band being further provided with an upper region and a lower region, the elongation zone being located between said upper and said lower region of said security band, and said security band further having at least one elastic region that is formed by the lower part of the security band between a holding strip and an elastic band;

wherein said holding strip is formed by a first portion of the security band and extends axially from said edge of the skirt to said lower region such that said lower region and said upper region are connected to the skirt when the screw closure is completely separated from the container, said first portion being free of both predetermined breaking lines and elongation zones, so that the holding strip will not break during an opening of said container and the lower region remains connected with the skirt; and wherein said elastic band is formed by a second portion of said security band, said second portion being provided with the predetermined breaking line and the elongation zone.

40. A security band in combination with a screw closure for a container, the screw closure having a top and a downwardly extending skirt, the security band comprising:

an upper band member coupled to the screw closure at a predetermined break line;

a lower band member disposed below the upper band member and the lower band member;

a holding strip formed by a portion axially extending of said security band such that said upper band member is connected to said skirt and said lower band member is connected to said upper band member, so that the holding strip will not break when the screw closure is removed from the container to retain the upper band member and the lower band member in contact with the skirt when the screw closure is completely separated from the container;

an elastic band elastically connecting the lower band member and the upper band member and elastically connecting the upper band member and the skirt; and at least one elastic region formed by the lower band member between the holding strip and the elastic band.

* * * * *